US006681839B1

(12) United States Patent
Balzer

(10) Patent No.: US 6,681,839 B1
(45) Date of Patent: Jan. 27, 2004

(54) HEAT EXCHANGER EXCHANGE-TUBE CLEANING LANCE POSITIONING SYSTEM

(76) Inventor: Brent A. Balzer, 16372 Jay Rd., Prairieville, LA (US) 70769

( * ) Notice: Subject to any disclaimer, the term of this patent is extended or adjusted under 35 U.S.C. 154(b) by 499 days.

(21) Appl. No.: 09/792,575

(22) Filed: Feb. 23, 2001

(51) Int. Cl.[7] ..... F28G 1/16; F28G 13/00; F28G 15/02; F28G 15/04; F28G 15/08

(52) U.S. Cl. ..... 165/11.2; 165/11.1; 165/95; 165/76; 122/379; 122/391; 122/392; 134/167 C; 134/166 C; 15/317; 901/47

(58) Field of Search ..... 165/11.2, 11.1, 165/76, 95; 122/379, 391, 392; 134/167 C, 166 C; 15/317; 901/47

(56) References Cited

U.S. PATENT DOCUMENTS

| | | | | | |
|---|---|---|---|---|---|
| 3,655,122 | A | | 4/1972 | Brown et al. | 239/226 |
| 3,794,051 | A | * | 2/1974 | Lee, Jr. et al. | 134/167 C |
| 3,911,750 | A | | 10/1975 | Prasher | 73/432 |
| 3,986,007 | A | * | 10/1976 | Ruoff, Jr. | 901/47 |
| 4,095,305 | A | * | 6/1978 | Goodwin | 134/167 C |
| 4,112,850 | A | | 9/1978 | Sigel-Gfeller | 104/138 |
| 4,244,296 | A | | 1/1981 | Vertut | 104/138 |
| 4,261,094 | A | | 4/1981 | Gerkey et al. | 29/427 |
| 4,347,652 | A | * | 9/1982 | Cooper, Jr. et al. | |
| 4,576,546 | A | * | 3/1986 | Copper, Jr. et al. | 165/76 |
| 4,602,163 | A | * | 7/1986 | Pryor | 901/47 |
| 4,604,715 | A | * | 8/1986 | Toutant et al. | 901/47 |
| 4,652,204 | A | * | 3/1987 | Arnett | 901/47 |
| 4,790,065 | A | | 12/1988 | Cooper, Jr. et al. | 29/723 |
| 4,812,666 | A | * | 3/1989 | Wistrand | 901/47 |
| 5,022,120 | A | * | 3/1991 | Boisture et al. | 165/95 |
| 5,022,463 | A | * | 6/1991 | Boisture | 65/95 |
| 5,154,198 | A | * | 10/1992 | Allen | 134/167 C |
| 5,320,072 | A | | 6/1994 | Theiss et al. | 122/382 |
| 5,348,234 | A | * | 9/1994 | v.d. Woude | 122/379 |
| 5,398,560 | A | | 3/1995 | Zollingger et al. | 73/865.8 |
| 5,423,917 | A | * | 6/1995 | Garcia, Jr. | 134/167 C |
| 5,514,219 | A | | 5/1996 | Kamler | 134/22.1 |
| 5,564,371 | A | * | 10/1996 | Ashton et al. | 122/379 |
| 5,735,964 | A | * | 4/1998 | Amuny | |
| 5,925,193 | A | | 7/1999 | Bude et al. | 134/18 |
| 6,105,539 | A | | 8/2000 | Ware et al. | 122/382 |

FOREIGN PATENT DOCUMENTS

| | | | |
|---|---|---|---|
| JP | 7-229695 | * | 8/1995 |
| JP | 2000-130703 | * | 5/2000 |

* cited by examiner

*Primary Examiner*—John K. Ford
(74) *Attorney, Agent, or Firm*—Joseph N. Breaux

(57) ABSTRACT

A heat exchanger exchange-tube cleaning lance positioning system that includes a three axis cleaning lance positioning mechanism that is attachable to the end of a heat exchanger and that is controlled by a lance position computer controller that determines the locations of each of the openings of the exchange-tubes of the heat exchanger by analyzing an image signal generated by a camera mounted to the three axis cleaning lance positioning mechanism and then positions a connected exchange tube cleaning lance into and through each of the exchange-tube passageways to clean the exchange-tube passageways automatically.

1 Claim, 10 Drawing Sheets

FIG. 1
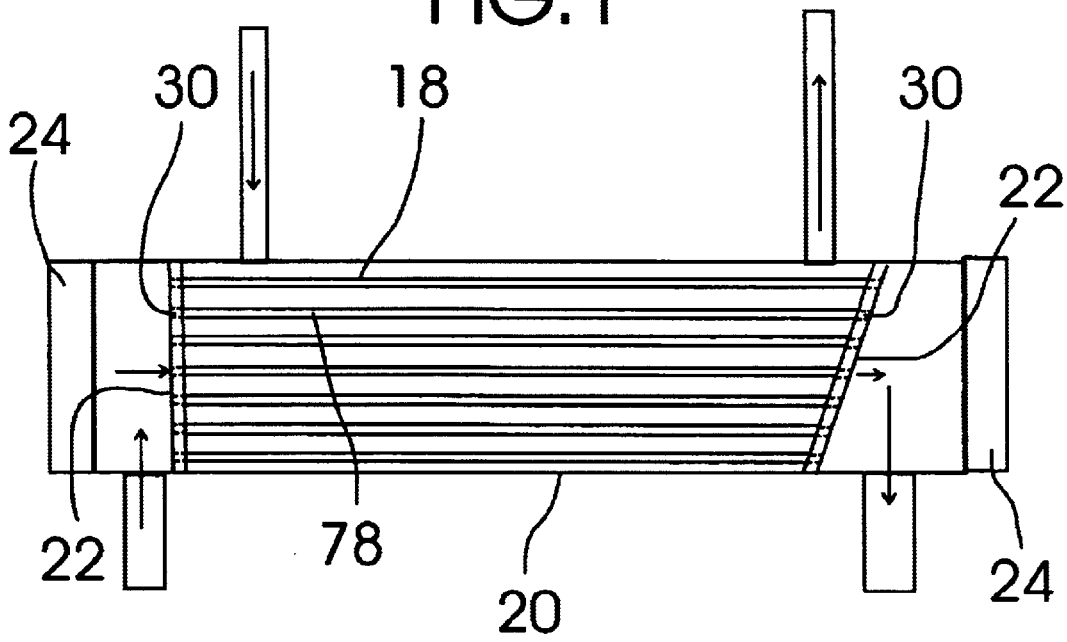
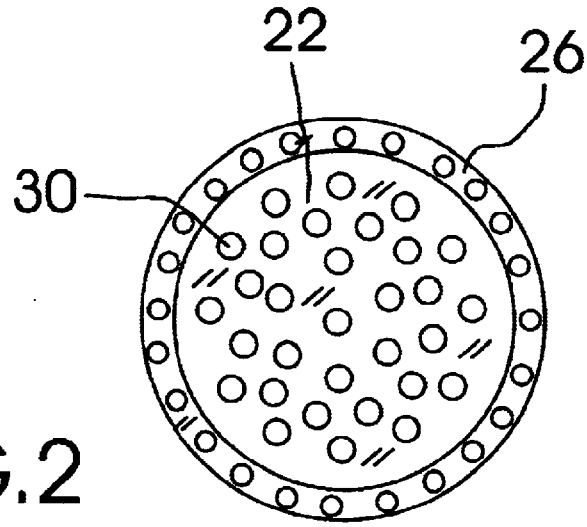
FIG. 2

FIG.9
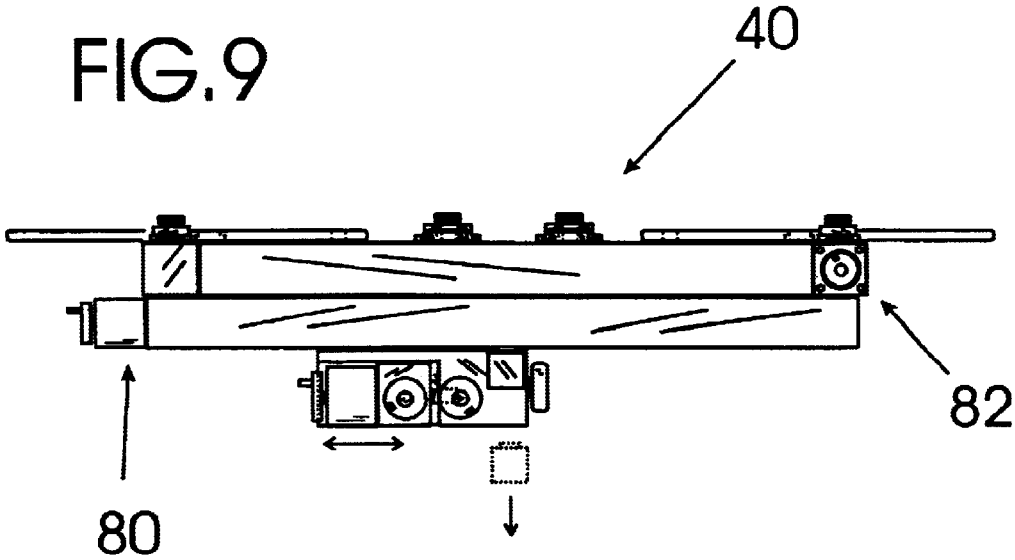
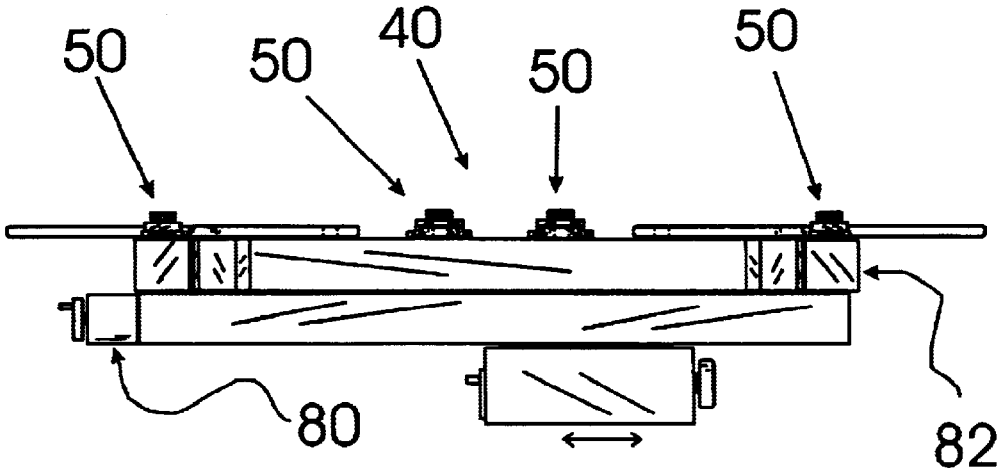
FIG.10

HEAT EXCHANGER EXCHANGE-TUBE CLEANING LANCE POSITIONING SYSTEM

TECHNICAL FIELD

The present invention relates to cleaning devices for heat exchangers and more particularly to a heat exchanger exchange-tube cleaning lance positioning system that includes a three axis cleaning lance positioning mechanism that is attachable to the end of a heat exchanger and that is controlled by a lance position computer controller that determines the location of each of the openings of the exchange-tubes of the heat exchanger by analyzing an image signal generated by a camera mounted to the three axis cleaning lance positioning mechanism and then positions a connected exchange tube cleaning lance into and through each of the exchange-tube passageways to clean the exchange-tube passageways automatically.

BACKGROUND ART

Heat exchangers are used extensively in manufacturing plants to maintain process control over various manufacturing processes such as in the production of plastics and other chemicals. Although these heat exchangers allow the plant to operate, they contain exchange-tubes through which the manufactured chemicals must flow that often become narrowed by the accumulation of the chemicals on the inner walls of the exchange-tubes. This narrowing causes inefficient heat exchange to occur and can reduce plant production. To counter this narrowing build up, work crews must typically, at least partially disassemble the plant in order to move the heat exchanger to a location where a work crew can then manually position a high pressure cleaning lance through each of the exchange-tubes to remove the narrowing build up. Cleaning the exchange-tubes manually with a high pressure cleaning lance is dangerous to the workers because the cleaning lance generates high pressure jets of water that can easily injure a worker and the narrowing buildup removed by the high pressure jets can include dangerous chemicals that can poison and/or chemically burn the skin, lungs, eyes and other body parts of the workers on the work crew. In addition, manual cleaning of the exchange-tubes with a high pressure cleaning lance is slow, physically exhausting and expensive to perform. It would be desirable, therefore, to have a portable lance positioning system which could be attached to an in place heat exchanger thereby eliminating the need for moving the heat exchanger to a cleaning location. It would be a further benefit to have a lance positioning system that would also automatically position the cleaning lance through each of the exchange-tubes to clean the tubes rapidly, with fewer men and without the physical exertion now required by current lancing techniques.

GENERAL SUMMARY DISCUSSION OF INVENTION

It is thus an object of the invention to provide a heat exchanger exchange-tube cleaning lance positioning system that includes a three-axis cleaning lance positioning mechanism; a camera mounted to the three axis cleaning lance positioning mechanism; and a lance position computer controller in image signal receiving connection with the camera and in controlling connection with the three-axis cleaning lance positioning mechanism, the lance position computer including a user control interface; the three-axis cleaning lance positioning mechanism including a heat exchanger head flange connecting mechanism for rigidly attaching a non-moving portion of the three-axis cleaning lance positioning mechanism to the heat exchanger head flange of a heat exchanger; a lance depth drive mechanism having a lance connecting structure for connecting an exchange-tube cleaning lance thereto and a lance positioning mechanism for linearly positioning a tip end of a connected exchange tube cleaning lance into and out of an exchange-tube of the heat exchanger when the tip end of a connected exchange tube cleaning lance is positioned in a direct line with a horizontal exchange-tube center coordinate and a vertical exchange-tube center coordinate that corresponds with the flow passageway of the exchange-tube and the front of the open end of the particular exchange-tube; a horizontal lance positioning mechanism in connection with the lance depth drive mechanism in a manner to position a connected exchange tube cleaning lance at a horizontal coordinate corresponding to the horizontal exchange-tube center coordinate for a particular exchange tube; and a vertical lance positioning mechanism in connection with the lance depth drive mechanism in a manner to position a connected exchange tube cleaning lance at a vertical coordinate corresponding to the vertical exchange-tube center coordinate for a particular exchange tube; the lance depth drive mechanism, the horizontal lance positioning mechanism and the vertical lance positioning mechanism all being moveably mechanically connected to the non-moving portion of the three-axis cleaning lance positioning mechanism in a manner such that, when the non-moving portion of the three-axis cleaning lance positioning mechanism is fixedly attached to the heat exchanger head flange, it is possible to position the tip end of a connected exchange tube cleaning lance in a direct line with a separate pair of horizontal and vertical exchange-tube center coordinates that correspond with the flow passageway and the front of the open end of each of the exchange-tubes connected to the tube sheet; the lance position computer controller being programmed to analyze an image signal corresponding to an image of the tube sheet received from the camera after the non-moving portion of the three-axis cleaning lance positioning mechanism is fixedly attached to the heat exchanger head flange in a manner to identify each open end and each flow passageway of each of the exchange-tubes connected to the tube sheet and to calculate and store a separate pair of horizontal and vertical exchange-tube center coordinates relative to the non-moving portion of the three-axis cleaning lance positioning mechanism that correspond with the flow passageway and the front of the open end of each of the exchange-tubes connected to the tube sheet; the lance position computer controller being responsive to input signals from the user control interface in a manner such that the lance position computer controller generates control signals to the lance depth drive mechanism, the horizontal lance positioning mechanism and the vertical lance positioning mechanism of the three-axis cleaning lance positioning mechanism such that a connected exchange tube cleaning lance is positioned into and out of each exchange-tube of the heat exchanger for which a separate pair of horizontal and vertical exchange-tube center coordinates is stored.

Accordingly, a heat exchanger exchange-tube cleaning lance positioning system is provided. The heat exchanger exchange-tube cleaning lance positioning system includes a three-axis cleaning lance positioning mechanism; a camera mounted to the three axis cleaning lance positioning mechanism; and a lance position computer controller in image signal receiving connection with the camera and in controlling connection with the three-axis cleaning lance positioning mechanism, the lance position computer including a user control interface; the three-axis cleaning lance positioning mechanism including a heat exchanger head flange connecting mechanism for rigidly attaching a non-moving portion of the three-axis cleaning lance positioning mechanism to the heat exchanger head flange of a heat exchanger; a lance depth drive mechanism having a lance connecting structure for connecting an exchange-tube cleaning lance thereto and a lance positioning mechanism for linearly positioning a tip end of a connected exchange tube cleaning lance into and out of an exchange-tube of the heat exchanger when the tip end of a connected exchange tube cleaning lance is positioned in a direct line with a horizontal exchange-tube center coordinate and a vertical exchange-tube center coordinate that corresponds with the flow passageway of the exchange-tube and the front of the open end of the particular exchange-tube; a horizontal lance positioning mechanism in connection with the lance depth drive mechanism in a manner to position a connected exchange tube cleaning lance at a horizontal coordinate corresponding to the horizontal exchange-tube center coordinate for a particular exchange tube; and a vertical lance positioning mechanism in connection with the lance depth drive mechanism in a manner to position a connected exchange tube cleaning lance at a vertical coordinate corresponding to the vertical exchange-tube center coordinate for a particular exchange tube; the lance depth drive mechanism, the horizontal lance positioning mechanism and the vertical lance positioning mechanism all being moveably mechanically connected to the non-moving portion of the three-axis cleaning lance positioning mechanism in a manner such that, when the non-moving portion of the three-axis cleaning lance positioning mechanism is fixedly attached to the heat exchanger head flange, it is possible to position the tip end of a connected exchange tube cleaning lance in a direct line with a separate pair of horizontal and vertical exchange-tube center coordinates that correspond with the flow passageway and the front of the open end of each of the exchange-tubes connected to the tube sheet; the lance position computer controller being programmed to analyze an image signal corresponding to an image of the tube sheet received from the camera after the non-moving portion of the three-axis cleaning lance positioning mechanism is fixedly attached to the heat exchanger head flange in a manner to identify each open end and each flow passageway of each of the exchange-tubes connected to the tube sheet and to calculate and store a separate pair of horizontal and vertical exchange-tube center coordinates relative to the non-moving portion of the three-axis cleaning lance positioning mechanism that correspond with the flow passageway and the front of the open end of each of the exchange-tubes connected to the tube sheet; the lance position computer controller being responsive to input signals from the user control interface in a manner such that the lance position computer controller generates control signals to the lance depth drive mechanism, the horizontal lance positioning mechanism and the vertical lance positioning mechanism of the three-axis cleaning lance positioning mechanism such that a connected exchange tube cleaning lance is positioned into and out of each exchange-tube of the heat exchanger for which a separate pair of horizontal and vertical exchange-tube center coordinates is stored.

In one preferred embodiment, the lance position computer controller generates control signals to the lance depth drive mechanism such that the connected cleaning lance moves inward in steps consisting of an outward portion and an inward portion; the inward portion being of a greater linear length than the outward portion.

In another preferred embodiment, the lance depth drive mechanism includes a force resistance sensor in connection with the lance position computer controller; and the lance position computer controller monitors a resistance signal from the force resistance sensor, stops the inward movement of the connected cleaning lance when the resistance signal from the force resistance sensor reaches a predetermined threshold value that indicates that the exchange-tube currently being cleaned has an unremovable clog, and completely withdraws the connected cleaning lance, and generates signals to the three-axis cleaning lance positioning mechanism to move the connected cleaning lance to the exchange tube corresponding to the next stored pair of horizontal and vertical exchange-tube center coordinates.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a side cutaway view showing a representative heat exchanger showing the exchange-tubes running through a cooling fluid tank and terminating at each end in an tube sheet.

FIG. 2 is an end plan view of a representative tube sheet showing the heat exchanger head flange and an open end of each of the exchange-tubes in the heat exchanger of FIG. 1.

FIG. 9 is a top side plan view of the three-axis cleaning lance positioning mechanism.

FIG. 10 is an under side plan view of the three-axis cleaning lance positioning mechanism.

EXEMPLARY MODE FOR CARRYING OUT THE INVENTION

Figure 3:
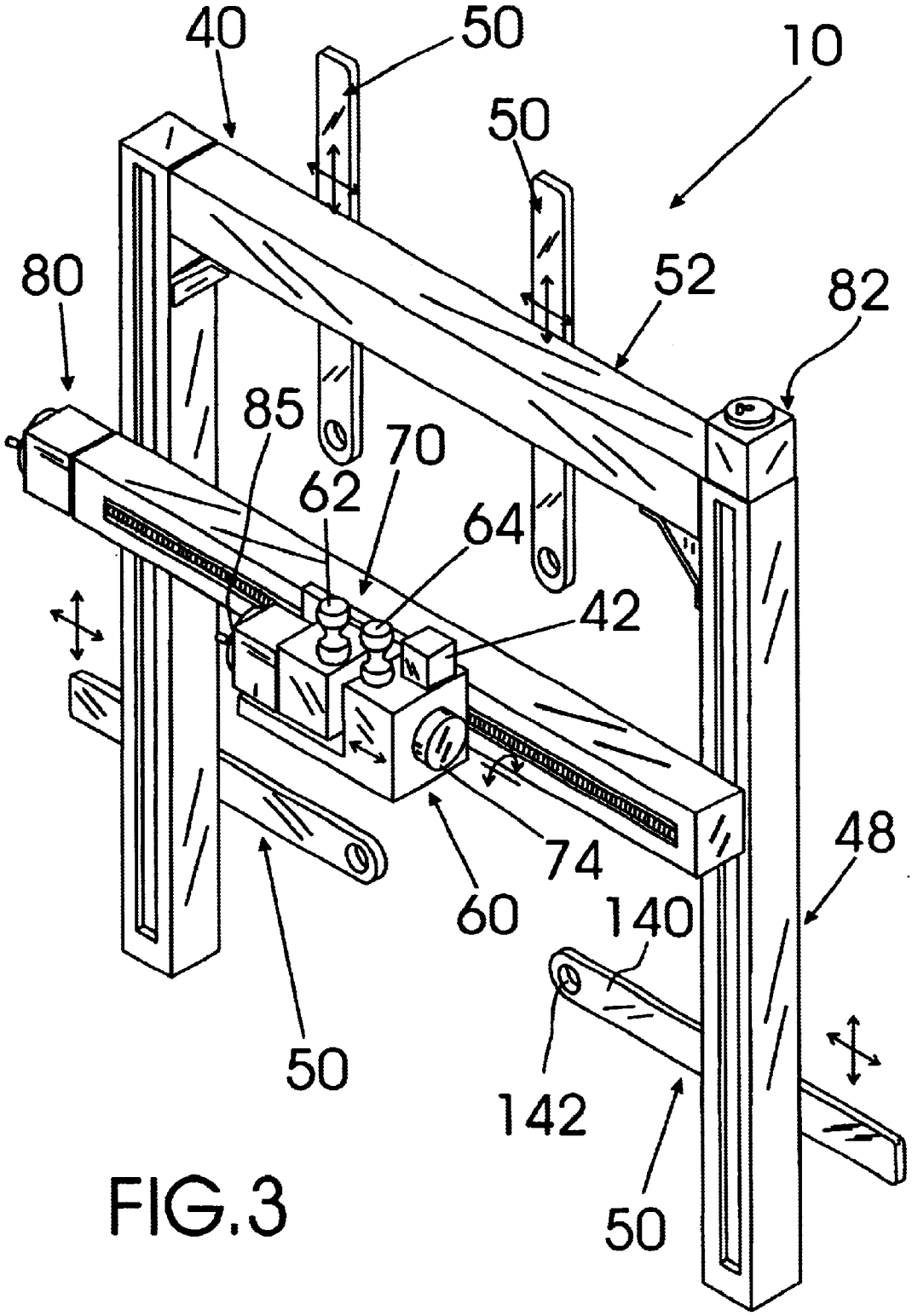
FIG. 3 is a perspective view of an exemplary embodiment of the three-axis cleaning lance positioning mechanism and a camera for capturing an image of the tube sheet so that the open end of each of the exchange-tubes in the heat exchanger may be identified and coordinates calculated by the lance position computer controller.
Figure 3A:
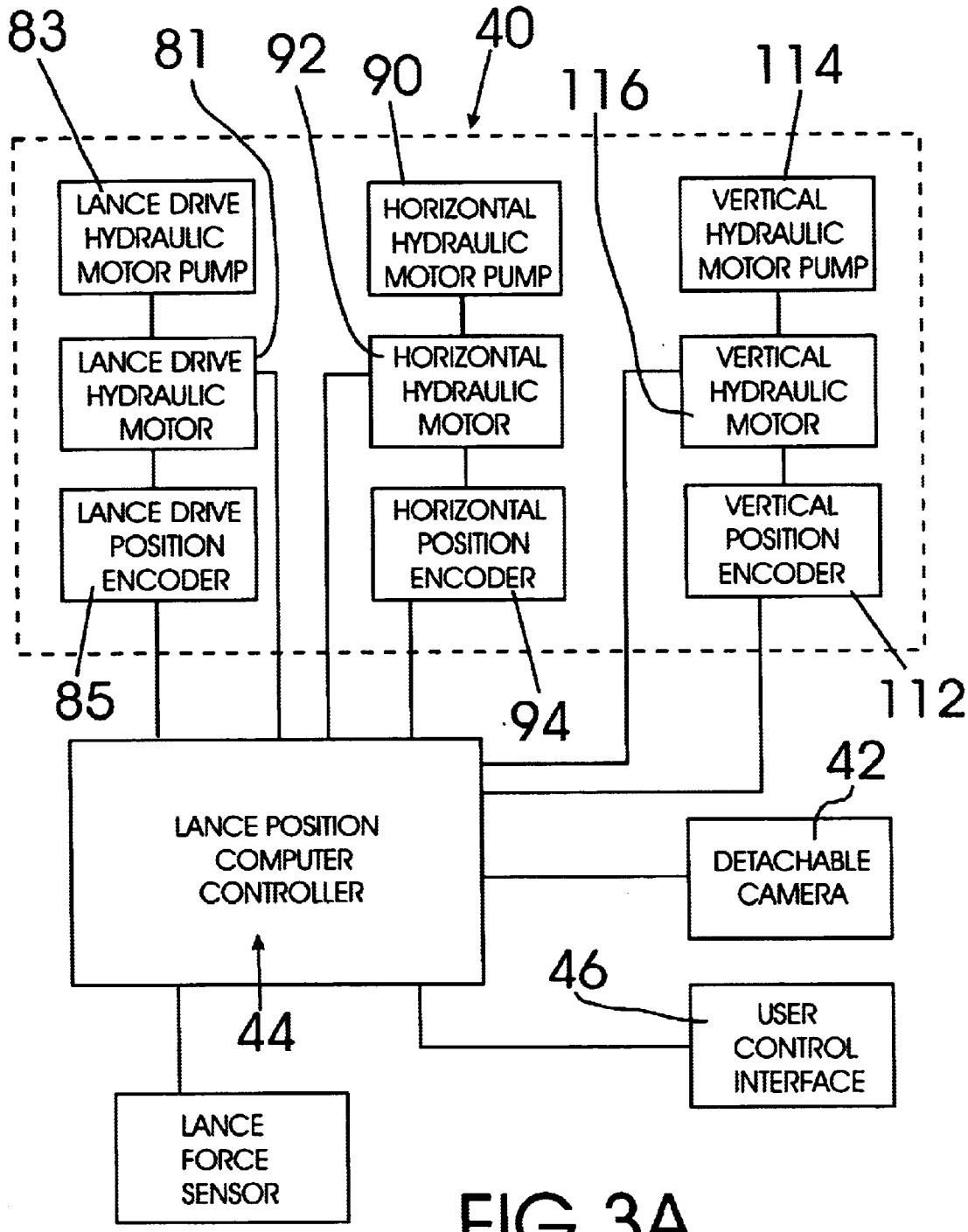
FIG. 3A is a schematic view of the lance depth drive mechanism, the horizontal positioner drive mechanism, and the vertical positioner drive mechanism for the three-axis cleaning lance positioning mechanism and the camera in connection with the lance position computer controller.
Figure 4:
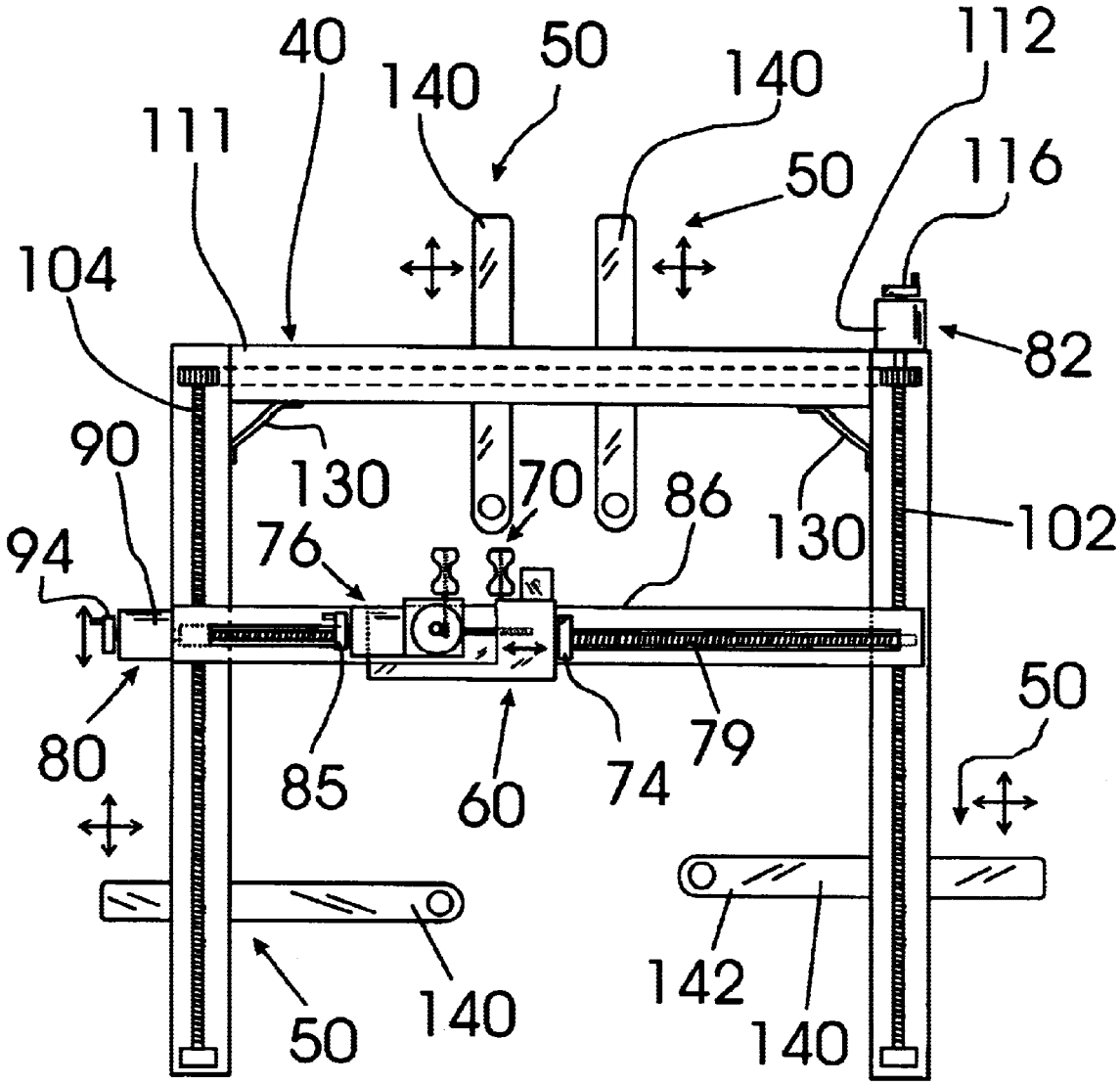
FIG. 4 is a side plan view of the outward facing side of the three-axis cleaning lance positioning mechanism.
Figure 5:
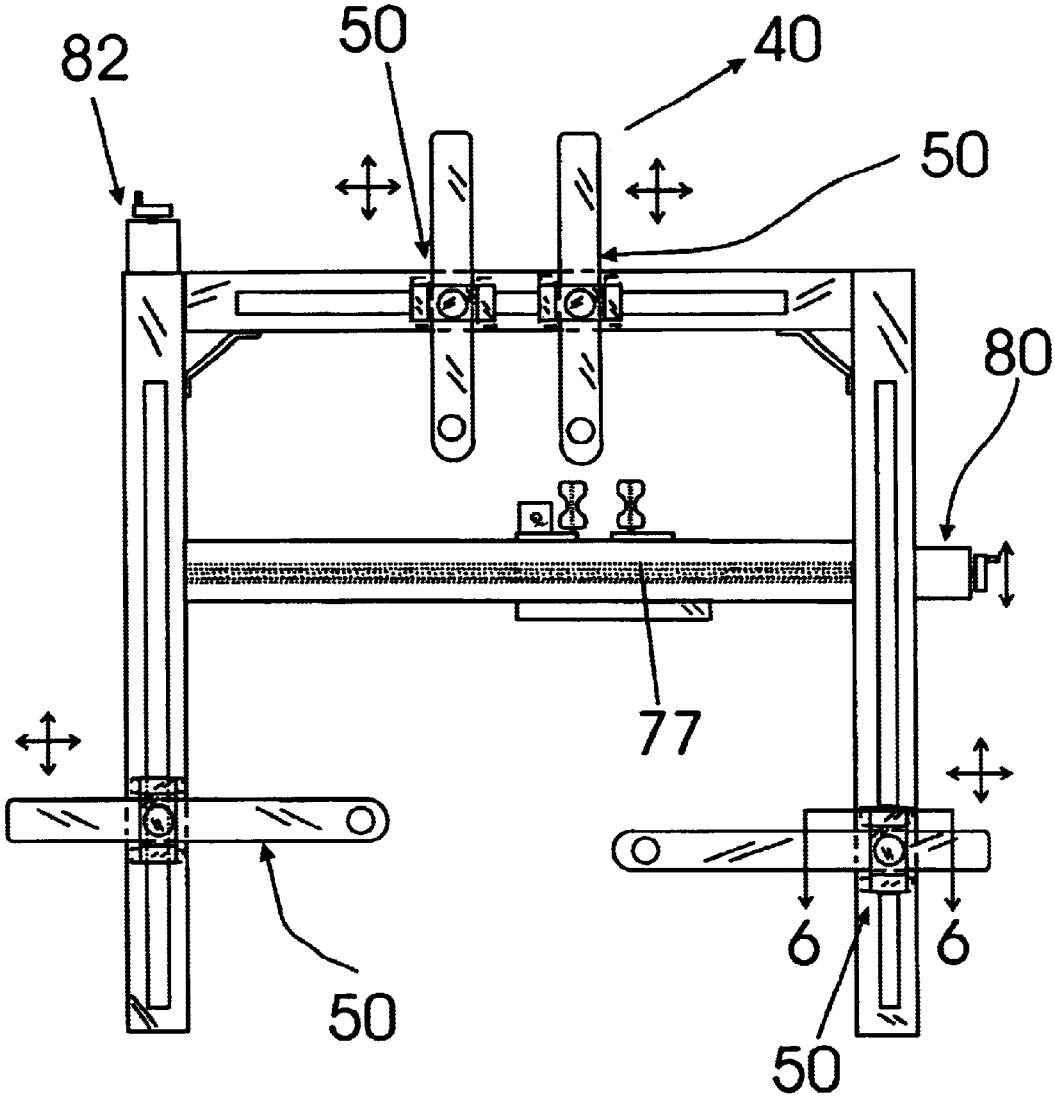
FIG. 5 is a side plan view of the tube sheet facing side of the three-axis cleaning lance positioning mechanism.

FIGS. 1–12, 3A and 6A show various aspects of an exemplary embodiment of the heat exchanger exchange-tube cleaning lance positioning system of the present invention generally designated 10 (shown in combination in FIGS. 3 and 3A). Heat exchanger exchange-tube cleaning lance positioning system 10 is adapted for manipulating and positioning an exchange-tube cleaning lance, such as rigid, elongated high pressure water exchange-tube cleaning lance 16, for cleaning the exchange-tubes 18 of a heat exchanger 20 having one or more tube sheets 22 accessible by removing an exchanger head 24 connected to a heat exchanger head flange 26; wherein tube sheet 22 has an open end 30 of each of the exchange-tubes 18 in the heat exchanger 20 provided therethrough such that a tip end 34 of exchange-tube cleaning lance 16 may be inserted into and through each of the exchange-tubes 18 of heat exchanger 20 by positioning the tip end 34 of the exchange-tube cleaning lance 16 through an open end 30 of each of the exchange-tubes 18 provided through tube sheet 22.

Heat exchanger exchange-tube cleaning lance positioning system 10 includes a three-axis cleaning lance positioning mechanism, generally designated 40; a camera 42 detachably mounted to three axis cleaning lance positioning mechanism 40; and a lance position computer controller 44 in image signal receiving connection with camera 42 and in controlling connection with the three-axis cleaning lance positioning mechanism 40. In this embodiment, lance position computer controller 44 includes a user control interface 46 in the form of a keyboard and mouse.

Three-axis cleaning lance positioning mechanism 40 includes a heat exchanger head flange connecting mechanism, generally designated 48, in the form of four two-axis positionable adjustable heat exchanger head flange connecting bar assemblies 50, for rigidly attaching a U-shaped, non-moving portion, generally designated 52, of three-axis cleaning lance positioning mechanism 40 to heat exchanger head flange 26 of heat exchanger 20; and a lance depth drive mechanism, generally designated 60, having a driven, compressible, hour-glass shaped, roller member 62 and a compressible, hour-glass shaped roller member 64 that forms a portion of the lance connecting structure, generally designated 70 for connecting an exchange-tube cleaning lance 16 thereto by compressing the roller members 62, 64 together by turning knob 74 to draw roller member 62 towards roller member 64 until sufficient compressive force is achieved to securely grip cleaning lance 16. The driven, compressible, hour-glass shaped, roller member 62 of lance depth drive mechanism 60 is used to move the connected exchange-tube cleaning lance 16 into and out of the flow passageways 78 of the exchange tubes 18 and is driven by a lance drive hydraulic motor 81 powered by a lance drive hydraulic motor pump 83 controlled by computer controller 44 that is provided with a lance drive position encoder 85 to provide lance tip position feedback to computer controller 44 so that accurate positioning of tip end 34 of cleaning lance 16 is possible.

Three-axis cleaning lance positioning mechanism 40 also includes a horizontal lance positioning mechanism, generally designated 80, and a vertical lance positioning mechanism, generally designated 82.

Lance depth drive mechanism 60 includes a ball nut 77 (shown in dashed lines) that is threaded onto a horizontal drive screw 79 of horizontal positioning mechanism 80 positioned within a channel of an elongated, horizontal extruded member 86, and turned by a horizontal hydraulic motor 90 to move lance depth drive mechanism 60 back and forth horizontally along horizontal extruded member 86. Horizontal hydraulic motor 90 is powered by a horizontal hydraulic motor pump 92 controlled by computer controller 44. A horizontal position encoder 94 connected to the shaft of horizontal hydraulic motor 90 and electrically to computer controller 44 provides horizontal position feedback to computer controller 44 so that accurate horizontal coordinate positioning of lance depth drive mechanism 60 is achievable.

Horizontal positioning mechanism 80 includes a ball nut 100 (shown in dashed lines) at each end of horizontal extruded member 86 that are each threaded onto a separate vertical drive screw 102, 104 that is positioned within a channel of one of two, parallel oriented, elongated, vertical extruded members 106, 108, respectively. Vertical drive screws 102, 104 are coupled by a belt 110 run through connecting extruded member 111 and turned by a vertical hydraulic motor 112 to move horizontal positioning mechanism 80 and lance depth drive mechanism 60 up and down vertically along vertical extruded members 106, 108. Vertical hydraulic motor 112 is powered by a vertical hydraulic motor pump 114 controlled by computer controller 44. A vertical position encoder 116 connected to the shaft of vertical hydraulic motor 112 and electrically to computer controller 44 provides vertical position feedback to computer controller 44 so that accurate vertical coordinate positioning of lance depth drive mechanism 60 is achievable.

It can be seen that U-shaped, non-moving portion 52 of three-axis cleaning lance positioning mechanism 40 is formed by the connection of the two spaced parallel vertical extruded members 106, 108 at their top ends to the opposite ends of connecting extruded member 111. Corner braces 130 are provided to add rigidity.

Figure 6A:
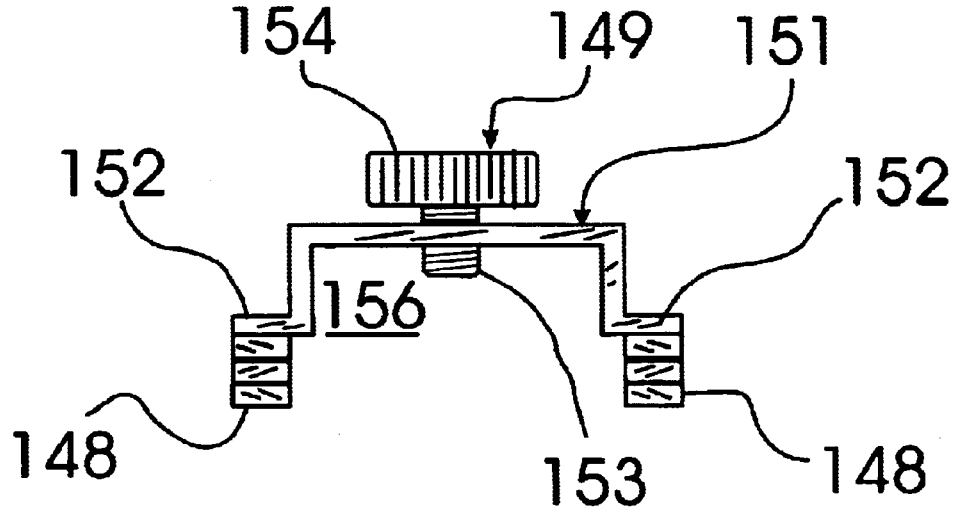
FIG. 6A is an end view of the slidable connecting bar positioning and locking mechanism in isolation showing the bar slide and the locking screw.
Figure 6:
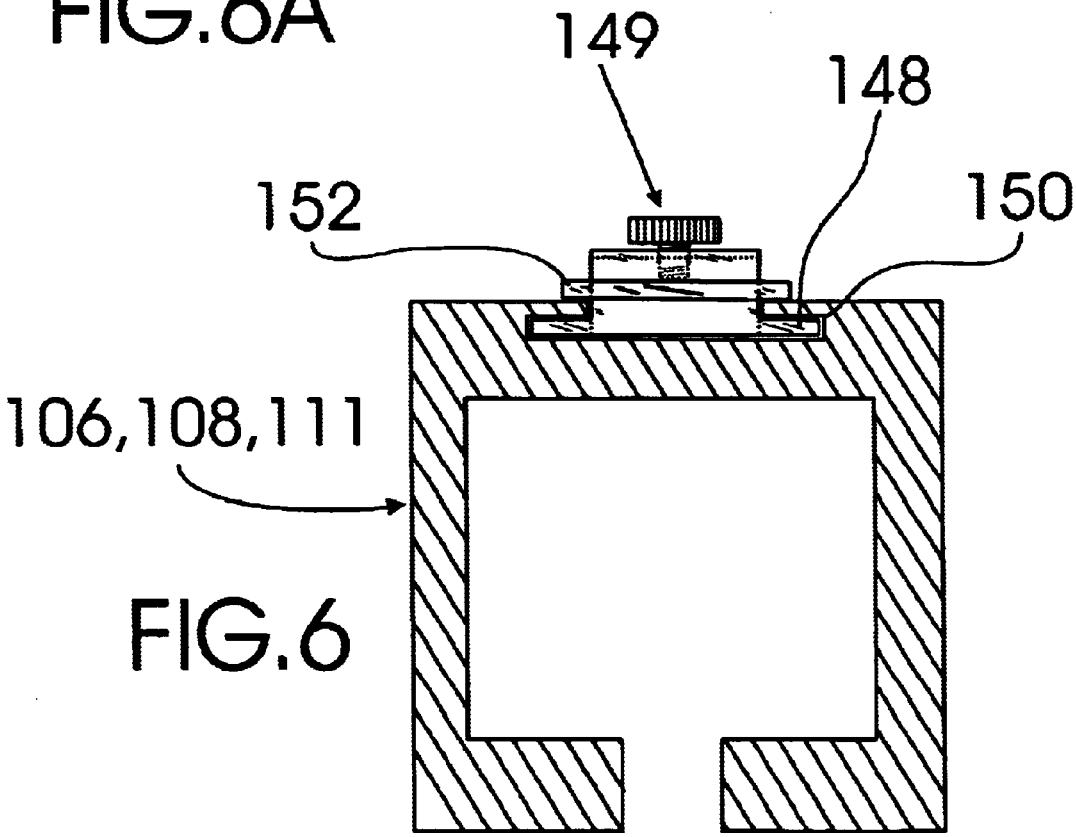
FIG. 6 is a sectional view along the line 6—6 of FIG. 5 showing the drive screw channel and the connecting bar lock slide channel of the rigid structural extrusion and the interior bar lock slides positioned within the connecting bar lock slide channel.
Figure 7:
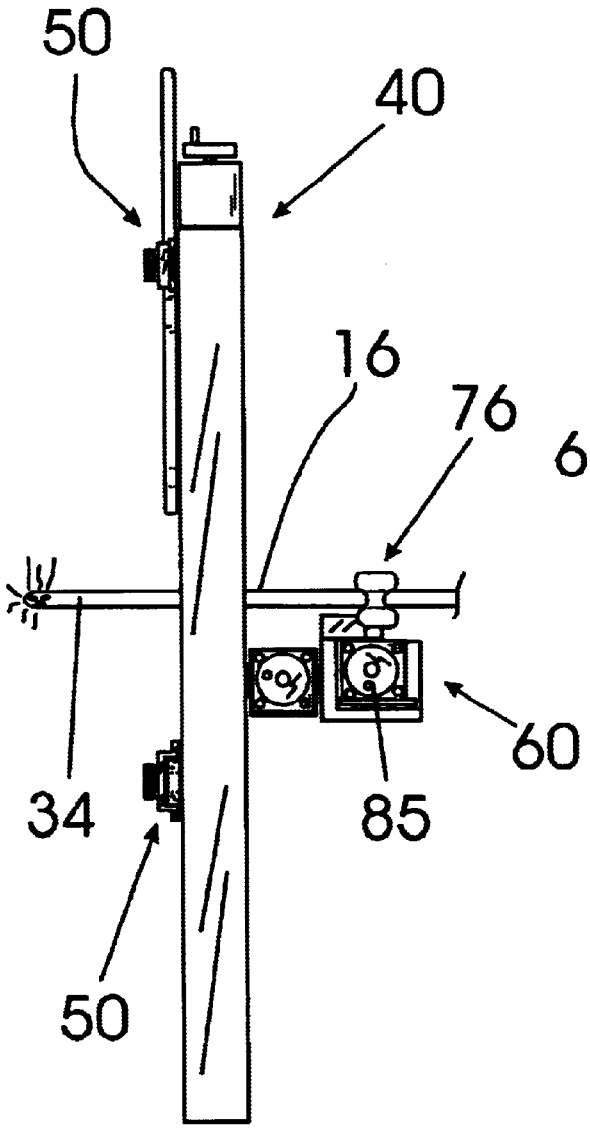
FIG. 7 is a left side plan view of the three-axis cleaning lance positioning mechanism.
Figure 8:
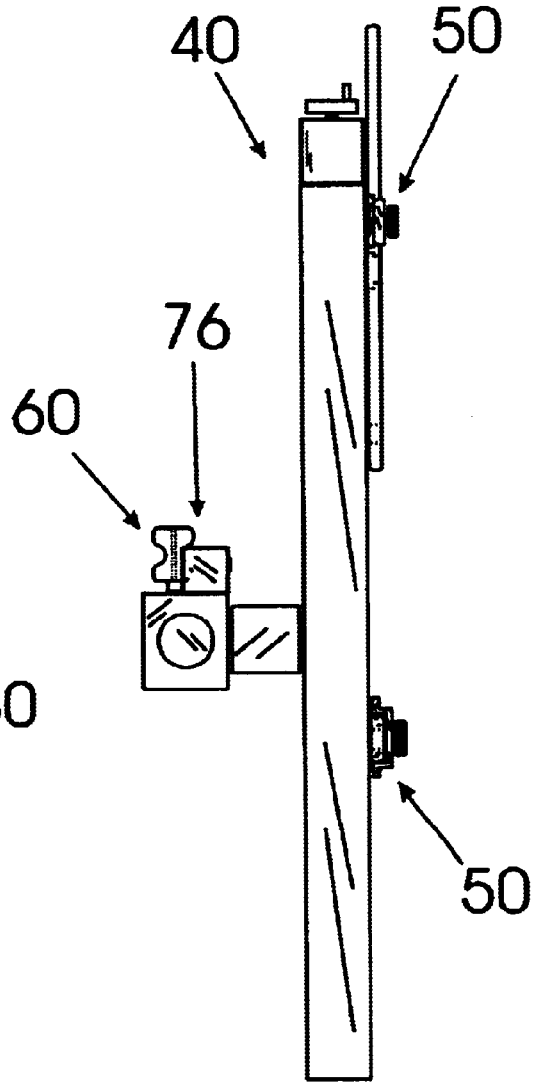
FIG. 8 is a right side plan view the three-axis cleaning lance positioning mechanism
Figure 11:
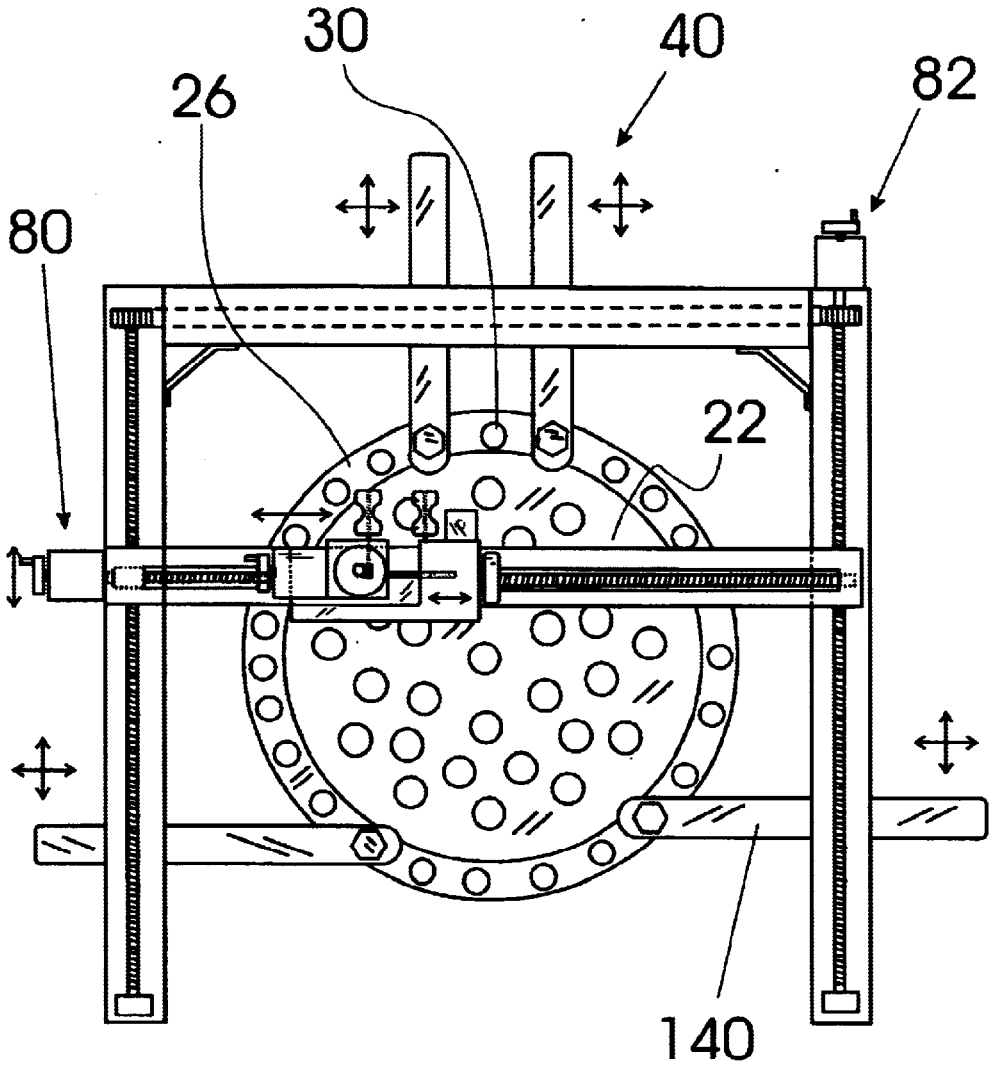
FIG. 11 is a front plan view of the three-axis cleaning lance positioning mechanism attached to the heat exchanger head flange of the representative tube sheet of FIGS. 1 and 2 showing the lance gripper and drive assembly drive rollers in the open non-gripping position.
Figure 12:
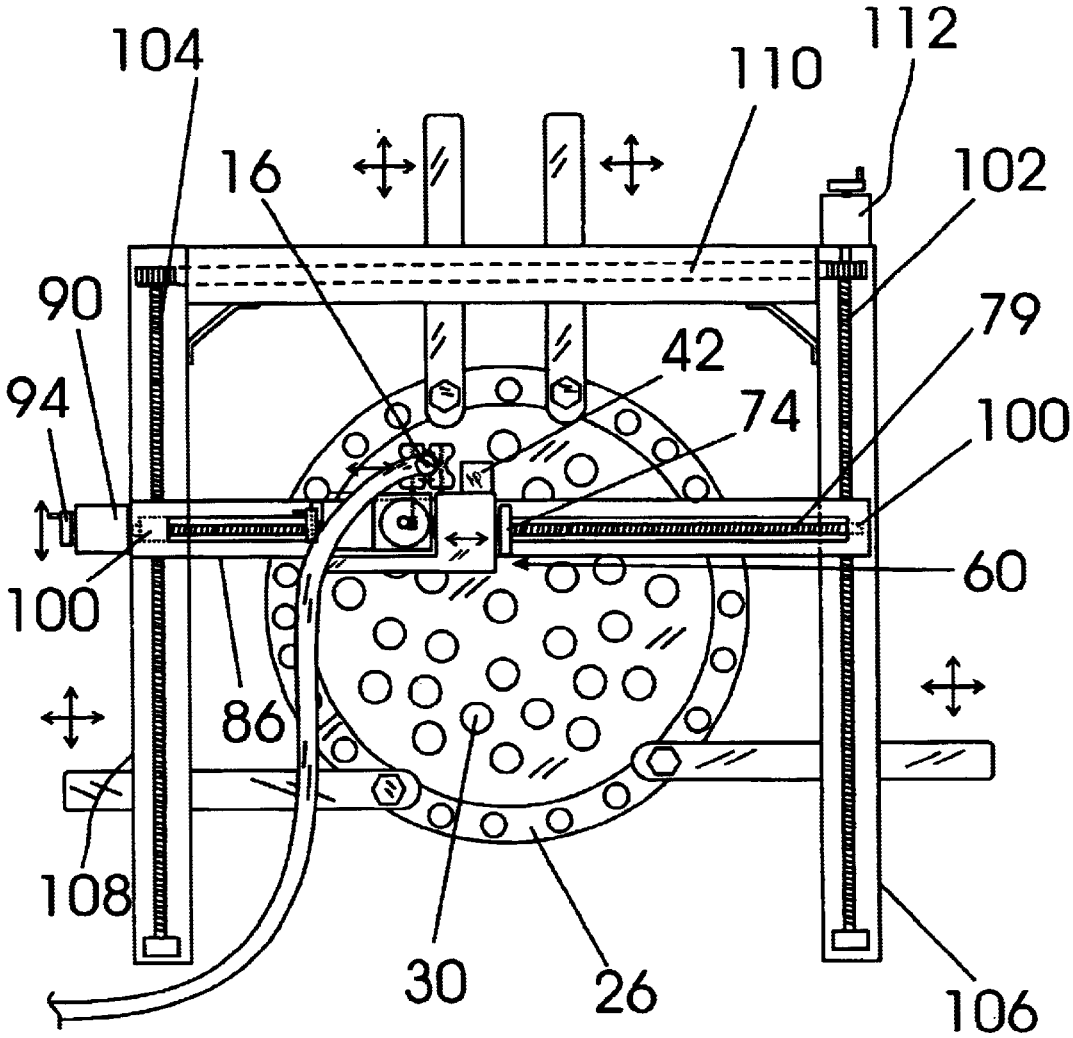
FIG. 12 is a front plan view of the three-axis cleaning lance positioning mechanism attached to the heat exchanger head flange of the representative tube sheet of FIGS. 1 and 2 showing the lance gripper and drive assembly drive rollers in the closed lance gripping and driving position and positioned in place for positioning a high pressure cleaning lance into and through one of the open end of one of the exchange-tubes in the heat exchanger.

One of the four two-axis positionable adjustable heat exchanger head flange connecting bar assemblies 50 is connected to each of the vertical extruded members 106,108, and two of the four two-axis positionable adjustable heat exchanger head flange connecting bar assemblies 50 are connected to connecting extruded member 111. Each of the four two-axis positionable adjustable heat exchanger head flange connecting bar assemblies 50 includes a rigid connecting bar 140 having a mounting aperture 142 and, as shown in FIGS. 6 and 6A, includes a slidable bar positioning and locking assembly 149 having a bar slide portion, generally designated 151 and a threaded locking screw 153 having a hand knob 154. Bar slide portion 151 includes a connecting bar receiving opening 156, two interior bar lock slides 148 slidably positioned within a T-shaped connecting bar lock slide channel 150 formed into the heat exchanger facing surfaces of vertical extruded members 106, 108, and connecting extruded member 111 and two outer bar lock slides that are slidably positioned adjacent to the heat exchanger facing surfaces of vertical extruded members 106,108, and connecting extruded member 111 and above the two interior bar lock slides 148.

In use, three-axis cleaning lance positioning mechanism 40 is rigidly attached to heat exchanger head flange 26 of heat exchanger 20 as previously described. Camera 42 is then activated to capture an image of the tube sheet 22 of the heat exchanger 20 and then send an image signal to lance position computer controller 44. Camera 42 may be removed or covered after this step to protect it from damage. Lance position computer controller 44 is then allowed to analyze the image signal from camera 42 to identify each open end 30 and each flow passageway 78 of each of the exchange-tubes 18 connected to the tube sheet 22 and to calculate and store a separate pair of horizontal and vertical exchange-tube center coordinates relative to the non-moving portion, U-shaped portion 52, of the three-axis cleaning lance positioning mechanism 40 that correspond with the flow passageway 78 and the front of the open end 30 of each of the exchange-tubes 18 connected to tube sheet 22. A high pressure water exchange-tube cleaning lance 16 is then connected to lance depth drive mechanism 60 as described to create a connected exchange tube cleaning lance 16. Lance position computer controller 44 is then activated by the user through user interface 46 to generate the required control signals to the lance depth drive mechanism 60, horizontal lance positioning mechanism 80, and vertical lance positioning mechanism 82 of three-axis cleaning lance positioning mechanism 40 such that the connected exchange tube cleaning lance 16 is positioned into and out of the passageway 78 of each exchange-tube 18 of heat exchanger 20.

It can be seen from the preceding description that a heat exchanger exchange-tube cleaning lance positioning system has been provided.

It is noted that the embodiment of the heat exchanger exchange-tube cleaning lance positioning system described herein in detail for exemplary purposes is of course subject to many different variations in structure, design, application and methodology. In particular, the choice of movement mechanisms may be varied to a large degree to include commonly used motion and positioning devices such as hydraulic cylinders, electric motors, pneumatic motors, etc. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A heat exchanger exchange-tube cleaning lance positioning system for use with an exchange-tube cleaning lance on a heat exchanger having an tube sheet accessible by removing an exchanger head connected to a heat exchanger head flange; the tube sheet having an open end of each of the exchange-tubes in the heat exchanger provided therethrough such that a tip end of an exchange-tube cleaning lance may be inserted into and through each of the exchange-tubes in the heat exchanger by positioning the tip end of the exchange-tube cleaning lance through the open end of each of the exchange-tubes provided through the tube sheet; the heat exchanger exchange-tube cleaning lance positioning system comprising:

a three-axis cleaning lance positioning mechanism;

a camera mounted to the three axis cleaning lance positioning mechanism; and a lance position computer controller in image signal receiving connection with the camera and in controlling connection with the three-axis cleaning lance positioning mechanism, the lance position computer including a user control interface;

the three-axis cleaning lance positioning mechanism including a heat exchanger head flange connecting mechanism for rigidly attaching a non-moving portion of the three-axis cleaning lance positioning mechanism to the heat exchanger head flange of a heat exchanger; a lance depth drive mechanism having a lance connecting structure for connecting an exchange-tube cleaning lance thereto and a lance positioning mechanism for linearly positioning a tip end of a connected exchange tube cleaning lance into and out of an exchange-tube of the heat exchanger when the tip end of a connected exchange tube cleaning lance is positioned in a direct line with a horizontal exchange-tube center coordinate and a vertical exchange-tube center coordinate that corresponds with the flow passageway of the exchange-tube and the front of the open end of the particular exchange-tube; a horizontal lance positioning mechanism in connection with the lance depth drive mechanism in a manner to position a connected exchange tube cleaning lance at a horizontal coordinate corresponding to the horizontal exchange-tube center coordinate for a particular exchange tube; and a vertical lance positioning mechanism in connection with the lance depth drive mechanism in a manner to position a connected exchange tube cleaning lance at a vertical coordinate corresponding to the vertical exchange-tube center coordinate for a particular exchange tube;

the lance depth drive mechanism, the horizontal lance positioning mechanism and the vertical lance positioning mechanism all being moveably mechanically connected to the non-moving portion of the three-axis cleaning lance positioning mechanism in a manner such that, when the non-moving portion of the three-axis cleaning lance positioning mechanism is fixedly attached to the heat exchanger head flange, it is possible to position the tip end of a connected exchange tube cleaning lance in a direct line with a separate pair of horizontal and vertical exchange-tube center coordinates that correspond with the flow passageway and the front of the open end of each of the exchange-tubes connected to the tube sheet;

the lance position computer controller being programmed to analyze an image signal corresponding to an image of the tube sheet received from the camera after the non-moving portion of the three-axis cleaning lance positioning mechanism is fixedly attached to the heat exchanger head flange in a manner to identify each open end and each flow passageway of each of the exchange-tubes connected to the tube sheet and to calculate and store a separate pair of horizontal and vertical exchange-tube center coordinates relative to the non-moving portion of the three-axis cleaning lance positioning mechanism that correspond with the flow passageway and the front of the open end of each of the exchange-tubes connected to the tube sheet;

the lance position computer controller being responsive to input signals from the user control interface in a manner such that the lance position computer controller generates control signals to the lance depth drive mechanism, the horizontal lance positioning mechanism and the vertical lance positioning mechanism of the three-axis cleaning lance positioning mechanism such that a connected exchange tube cleaning lance is positioned into and out of each exchange-tube of the heat exchanger for which a separate pair of horizontal and vertical exchange-tube center coordinates is stored;

the lance depth drive mechanism including a force resistance sensor in connection with the lance position computer controller;

the lance position computer controller monitoring a resistance signal from the force resistance sensor and stopping the inward movement of the connected cleaning lance when the resistance signal from the force resistance sensor reaches a predetermined threshold value indicating a clogged exchange tube, completely withdrawing the connected cleaning lance, and generating signals to the three-axis cleaning lance positioning mechanism to move the connected cleaning lance to the exchange tube corresponding to the next stored pair of horizontal and vertical exchange-tube center coordinates.

* * * * *